US010493458B2

(12) United States Patent
Engel

(10) Patent No.: US 10,493,458 B2
(45) Date of Patent: Dec. 3, 2019

(54) APPARATUS AND METHOD FOR A HOUSING ASSEMBLY

(71) Applicant: Kolberg-Pioneer, Inc., Yankton, SD (US)

(72) Inventor: Gary Engel, Yankton, SD (US)

(73) Assignee: Kolberg-Pioneer, Inc., Yankton, SD (US)

( * ) Notice: Subject to any disclaimer, the term of this patent is extended or adjusted under 35 U.S.C. 154(b) by 619 days.

(21) Appl. No.: 15/205,868

(22) Filed: Jul. 8, 2016

(65) Prior Publication Data

US 2017/0008002 A1 Jan. 12, 2017

Related U.S. Application Data

(60) Provisional application No. 62/190,485, filed on Jul. 9, 2015.

(51) Int. Cl.

| | |
|---|---|
| ***B02C 1/04*** | (2006.01) |
| ***B02C 2/02*** | (2006.01) |
| ***B02C 13/02*** | (2006.01) |
| ***B02C 13/30*** | (2006.01) |
| ***B02C 13/10*** | (2006.01) |
| ***B02C 1/02*** | (2006.01) |
| ***B02C 2/06*** | (2006.01) |

(52) U.S. Cl.

CPC ..... *B02C 1/04* (2013.01); *B02C 2/02* (2013.01); *B02C 2/06* (2013.01); *B02C 13/02* (2013.01); *B02C 13/10* (2013.01); *B02C 13/30* (2013.01)

(58) Field of Classification Search

None

See application file for complete search history.

(56) References Cited

U.S. PATENT DOCUMENTS 1,774,159 A * 8/1930 Schmidt, Jr. ..... B02C 1/04 241/217

3,061,317 A * 10/1962 Pollitz ..... B02C 1/02 277/420

* cited by examiner

*Primary Examiner* — Adam J Eiseman

*Assistant Examiner* — Mohammed S. Alawadi

(74) *Attorney, Agent, or Firm* — Chambliss, Bahner & Stophel, P.C.

(57) ABSTRACT

A housing assembly for a rock crusher having an eccentric shaft. The housing assembly has an interior side and an exterior side and comprises a first housing portion having an inner side, an outer side, and a plurality of grooves and being removably attached to the rock crusher, and a second housing portion having a plurality of grooves and being removably attached to the first housing portion. The housing assembly also comprises an inner ring having at least one inner ring housing groove and at least one inner ring pitman groove and being disposed on the interior side of the housing assembly, and an outer ring having at least one outer ring groove and being disposed on the exterior side of the housing assembly. The housing assembly is disposed around the eccentric shaft. A method for removably housing a bearing assembly on a rock crusher.

18 Claims, 9 Drawing Sheets

APPARATUS AND METHOD FOR A HOUSING ASSEMBLY

CROSS-REFERENCES TO RELATED APPLICATIONS/PATENTS

This application relates back to and claims the benefit of priority from U.S. Provisional Application for Patent Ser. No. 62/190,485 titled "Bearing Assembly" and filed on Jul. 9, 2015.

FIELD OF THE INVENTION

The present invention relates generally to apparatuses and methods for housing assemblies, and particularly to apparatuses and methods for housing assemblies adapted for use on rock crushers.

BACKGROUND AND DESCRIPTION OF THE PRIOR ART

It is known to use apparatuses and methods for housing assemblies on rock crushers. Conventional apparatuses and methods, however, suffer from one or more disadvantages. For example, conventional housing assemblies are undesirably complex. Conventional housing assemblies also include an undesirably large number of machined parts and fasteners. Conventional housing assemblies are also undesirably large in size. Conventional housing assemblies are also not sufficiently robust and durable. In addition, conventional housing assemblies are undesirably difficult to maintain, repair, remove, and replace. Finally, conventional housing assemblies are undesirably expensive to manufacture and maintain.

It would be desirable, therefore, if an apparatus and method for a housing assembly could be provided that would less complex. It would also be desirable if such an apparatus and method for a housing assembly could be provided that would include fewer machined parts and fasteners. It would be further desirable if such an apparatus and method for a housing assembly could be provided that would be more compact in size. It would be still further desirable if such an apparatus and method for a housing assembly could be provided that would be more robust and durable. It would also be desirable if such an apparatus and method for a housing assembly could be provided that would be easier to maintain, repair, remove, and replace. It would be further desirable if such an apparatus and method for a housing assembly could be provided that would be less expensive to manufacture and repair.

Advantages of the Preferred Embodiments of the Invention

Accordingly, it is an advantage of the preferred embodiments of the invention claimed herein to provide an apparatus and method for a housing assembly that is less complex and includes fewer machined parts and fasteners. It is also an advantage of the preferred embodiments of the invention claimed herein to provide an apparatus and method for a housing assembly that is more compact in size. It is still another advantage of the preferred embodiments of the invention claimed herein to provide an apparatus and method for a housing assembly that is more robust and durable. It is yet another advantage of the preferred embodiments of the invention claimed herein to provide an apparatus and method for a housing assembly that is easier to maintain, repair, remove, and replace. It is a further advantage of the preferred embodiments of the invention claimed herein to provide an apparatus and method for a housing assembly that is less expensive to manufacture and maintain.

Additional advantages of the preferred embodiments of the invention will become apparent from an examination of the drawings and the ensuing description.

SUMMARY OF THE INVENTION

The apparatus of the invention comprises a housing assembly. The preferred housing assembly has an interior side and an exterior side and comprises a first housing portion having an inner side, an outer side, and a plurality of grooves and being adapted to be removably attached to the rock crusher. The preferred housing assembly also comprises a second housing portion having a plurality of grooves and being adapted to be removably attached to the first housing portion. The preferred housing assembly further comprises an inner ring having at least one inner ring housing groove and at least one inner ring pitman groove and being disposed on the interior side of the housing assembly. The preferred housing assembly still further comprises an outer ring having at least one outer ring groove and being disposed on the exterior side of the housing assembly. The preferred housing assembly is disposed around the eccentric shaft.

The method of the invention comprises a method for removably housing a bearing assembly on a rock crusher having an eccentric shaft. The preferred method comprises providing a housing assembly. The preferred housing assembly has an interior side and an exterior side and comprises a first housing portion having an inner side, an outer side, and a plurality of grooves and being adapted to be removably attached to the rock crusher. The preferred housing assembly also comprises a second housing portion having a plurality of grooves and being adapted to be removably attached to the first housing portion. The preferred housing assembly further comprises an inner ring having at least one inner ring housing groove and at least one inner ring pitman groove and being disposed on the interior side of the housing assembly. The preferred housing assembly still further comprises an outer ring having at least one outer ring groove and being disposed on the exterior side of the housing assembly. The preferred housing assembly is disposed around the eccentric shaft. The preferred method also comprises removing the second housing portion from the first housing portion.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
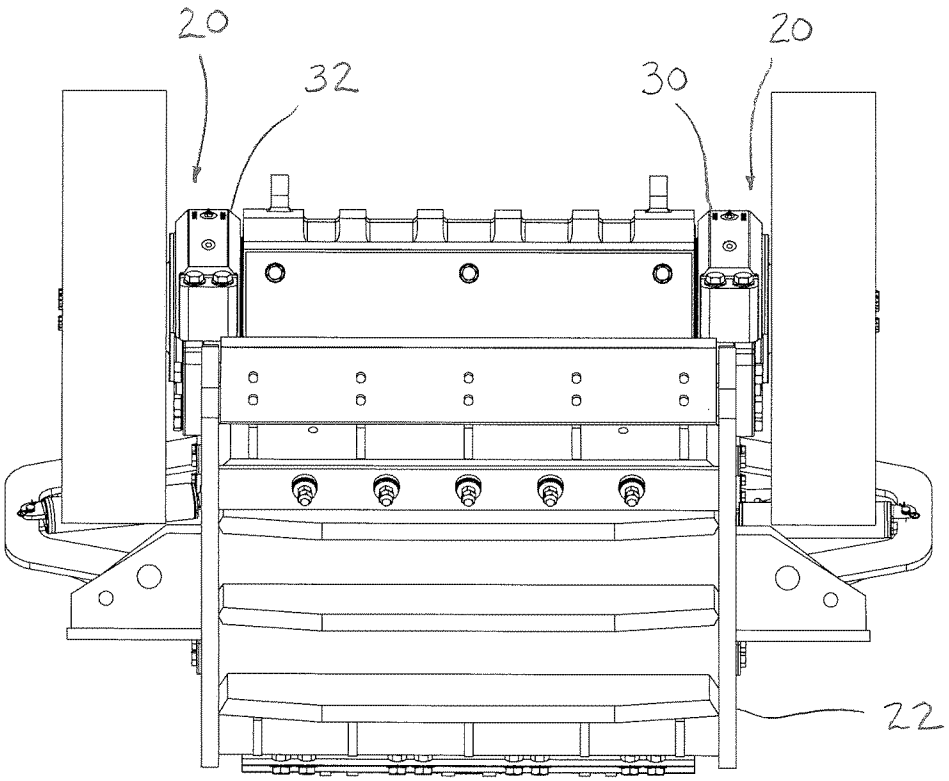
FIG. 1 is a front view of the preferred embodiment of the housing assembly in accordance with the present invention shown on an exemplary rock crusher.

Referring now to the drawings, the preferred embodiment of the housing assembly in accordance with the present invention is illustrated by FIGS. 1-18. As shown in FIGS. 1-18, the preferred housing assembly is relatively simple and includes few machined parts and fasteners. The preferred housing assembly is also robust, durable, and compact in size. In addition, the preferred housing assembly is easy and inexpensive to manufacture, maintain, repair, and replace.

Referring now to FIG. 1, a front view of the preferred embodiment of the housing assembly in accordance with the present invention shown on an exemplary rock crusher is illustrated. As shown in FIG. 1, the preferred housing assembly is designated generally by reference numeral 20. Preferred housing assembly 20 is adapted for use on exemplary rock crusher 22 and comprises fixed end housing assembly 30 and float end housing assembly 32. Preferably, housing assembly 20 is assembly is adapted to removably retain a bearing assembly. While FIG. 1 illustrates the preferred housing assembly on an exemplary jaw crusher, it is contemplated within the scope of the invention that the housing assembly may be used on any suitable type of rock crusher such as a horizontal shaft impact crusher, a hammer mill crusher, a roll crusher and the like.

Figure 2:
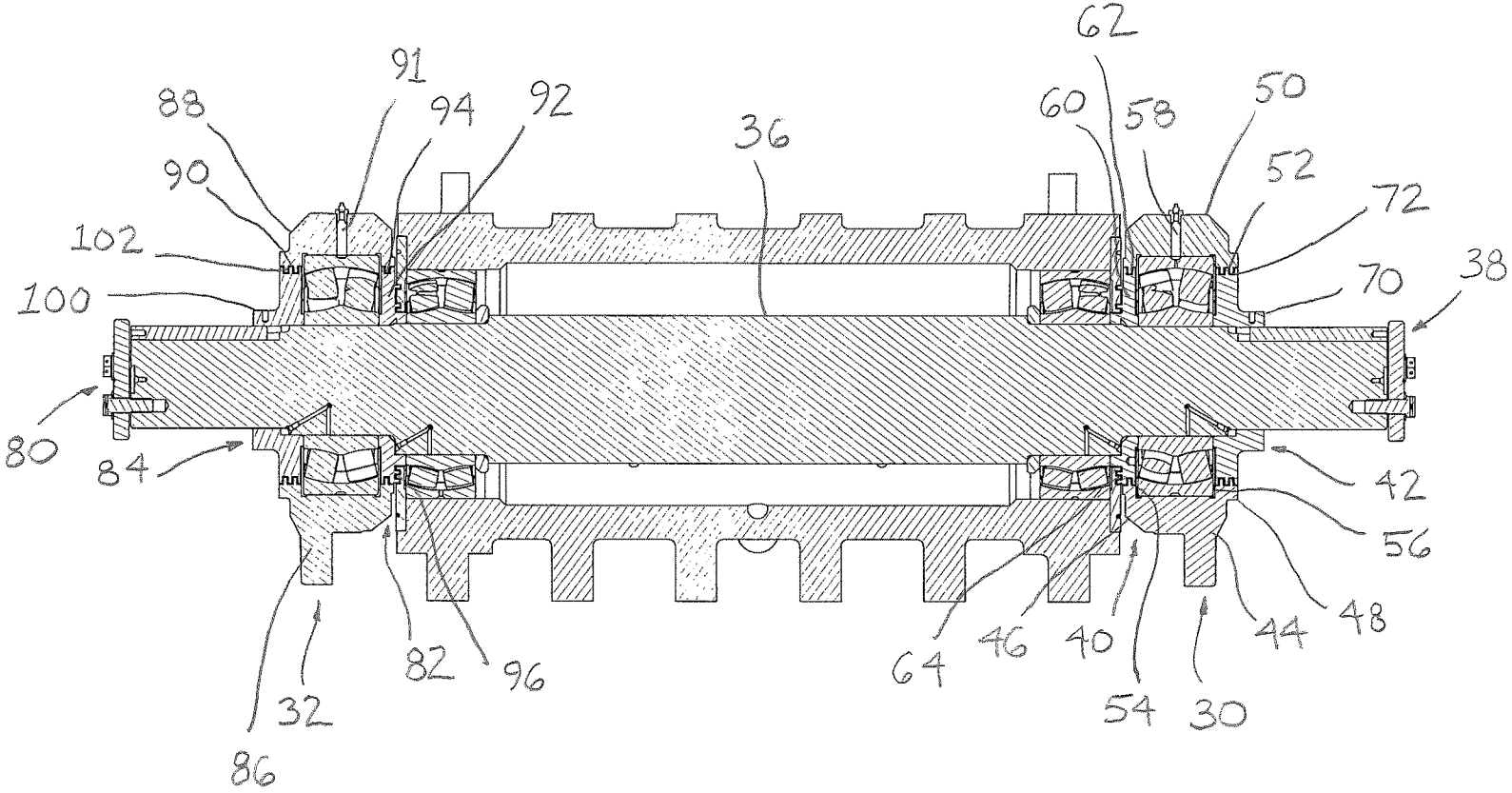
FIG. 2 is a sectional front view of the preferred housing assembly illustrated in FIG. 1.

Referring now to FIG. 2, a sectional front view of preferred housing assembly 20 is illustrated. As shown in FIG. 2, preferred housing assembly 20 comprises fixed end housing assembly 30 and float end housing assembly 32. Preferred fixed end housing assembly 30 is disposed around eccentric shaft 36 adjacent to fixed end 38 of the eccentric shaft. Preferred fixed end housing assembly has interior side 40 and exterior side 42 and comprises first fixed end housing portion 44 having inner side 46 and outer side 48. Preferably, first fixed end housing portion 44 is adapted to be removably attached to rock crusher 22. Preferred fixed end housing assembly 30 also comprises second fixed end housing portion 50 which is adapted to be removably attached to first fixed end housing portion 44. Preferred fixed end housing assembly 30 also comprises a plurality of fixed end housing assembly grooves 52 which are machined into the fixed end housing assembly. See also FIGS. 6 and 10. Preferred fixed end housing assembly 30 further comprises inner spacer 54 which is disposed on inner side 46 of first fixed end housing portion 44 and outer spacer 56 which is disposed on outer side 48 of first fixed end housing portion 44. See also FIG. 6. In addition, preferred fixed end housing assembly comprises channel 58.

Preferred fixed end first housing portion 44 and the fixed end second housing portion 50 are stationary when eccentric shaft 36 rotates.

Still referring to FIG. 2, preferred fixed end housing assembly 30 still further comprises fixed end inner ring 60 having at least one fixed end inner ring housing groove 62 which is machined into the fixed end inner ring and at least one fixed end inner ring pitman groove 64. See also FIGS. 6 and 11. Preferred fixed end inner ring 60 is disposed on interior side 40 of fixed end housing assembly 30. In addition, preferred fixed end housing assembly comprises fixed end outer ring 70 having at least one fixed end outer ring groove 72 which is machined into the fixed end outer ring. See also FIGS. 6 and 17. Preferred fixed end outer ring 70 is disposed on exterior side 42 of fixed end housing assembly 30. Preferred fixed end inner ring 60 and preferred fixed end outer ring 70 are adapted to rotate with eccentric shaft 36.

Still referring to FIG. 2, preferred housing assembly 20 also comprises float end housing assembly 32. Preferred float end housing assembly 32 is disposed around eccentric shaft 36 adjacent to float end 80 of the eccentric shaft. Preferred float end housing assembly 32 has interior side 82 and exterior side 84 and comprises first float end housing portion 86 which is adapted to be removably attached to rock crusher 22 and second float end housing portion 88 which is adapted to be removably attached to the first float end housing portion. Preferred float end housing assembly 32 comprises a plurality of float end housing assembly grooves 90 which are machined into the float end housing assembly and channel 91. Preferred float end first housing portion 86 and preferred float end second housing portion 88 are stationary when eccentric shaft 36 rotates.

Still referring to FIG. 2, preferred float end housing assembly 32 also comprises float end inner ring 92 having at least one float end inner ring housing groove 94 which is machined into the float end inner ring and at least one float end inner ring pitman groove 96. See also FIG. 7. Preferably, float end inner ring 92 is disposed on interior side 82 of float end housing assembly 32. Preferred float end housing assembly 32 further comprises float end outer ring 100 having at least one float end outer ring groove 102 which is machined into the float end outer ring. Preferred float end outer ring 100 is disposed on exterior side 84 of float end housing assembly 32. Preferred float end inner ring 92 and preferred float end outer ring 100 are adapted to rotate with eccentric shaft 36. While FIG. 2 illustrates the preferred configuration and arrangement of the housing assembly, it is contemplated within the scope of the invention that the housing assembly may be of any suitable configuration and arrangement.

Figure 3:
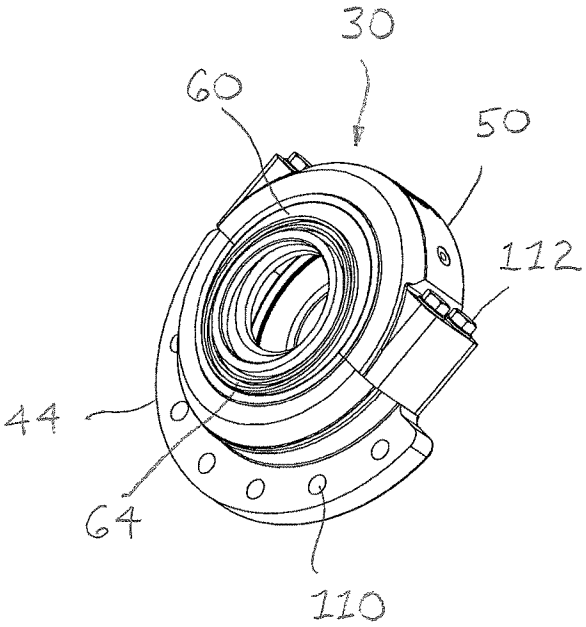
FIG. 3 is an interior side perspective view of the fixed end housing assembly of the preferred housing assembly illustrated in FIGS. 1-2.

Referring now to FIG. 3, an interior side perspective view of fixed end housing assembly 30 of preferred housing assembly 20 is illustrated. As shown in FIG. 3, preferred fixed end housing assembly 30 comprises first housing portion 44, second housing portion 50, inner ring 60, inner ring pitman grooves 64, holes 110, and bolts 112.

Figure 4:
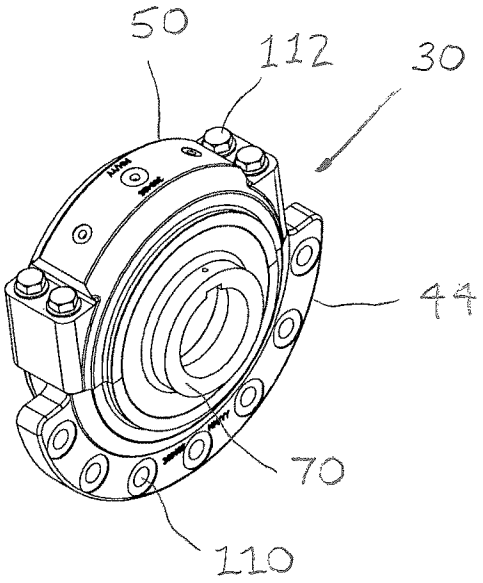
FIG. 4 is an exterior side perspective view of the fixed end housing assembly of the preferred housing assembly illustrated in FIGS. 1-3.

Referring now to FIG. 4, an exterior side perspective view of fixed end housing assembly 30 of preferred housing assembly 20 is illustrated. As shown in FIG. 4, preferred fixed end housing assembly 30 comprises first housing portion 44, second housing portion 50, outer ring 70, holes 110, and bolts 112.

Figure 5:
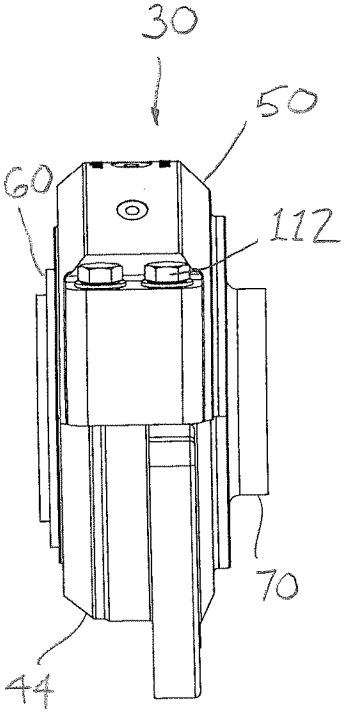
FIG. 5 is a front view of the fixed end housing assembly of the preferred housing assembly illustrated in FIGS. 1-4.

Referring now to FIG. 5, a front view of fixed end housing assembly 30 of preferred housing assembly 20 is illustrated. As shown in FIG. 5, preferred fixed end housing assembly 30 comprises first housing portion 44, second housing portion 50, inner ring 60, outer ring 70, and bolts 112.

Figure 6:
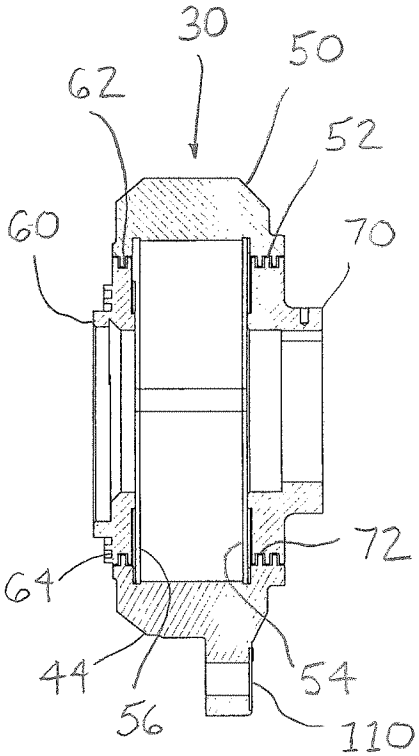
FIG. 6 is a sectional front view of the fixed end housing assembly of the preferred housing assembly illustrated in FIGS. 1-5.

Referring now to FIG. 6, a sectional front view of fixed end housing assembly 30 of preferred housing assembly 20 is illustrated. As shown in FIG. 6, preferred fixed end housing assembly 30 comprises first housing portion 44, second housing portion 50, housing assembly grooves 52, inner spacer 54, outer spacer 56, inner ring 60, inner ring housing groove 62, inner ring pitman grooves 64, outer ring 70, outer ring grooves 72, and hole 110. Preferably, the plurality of fixed end housing assembly grooves 52, the at least one fixed end inner ring housing groove 62, and the at least one fixed end outer ring groove 72 form a labyrinth seal.

Figure 7:
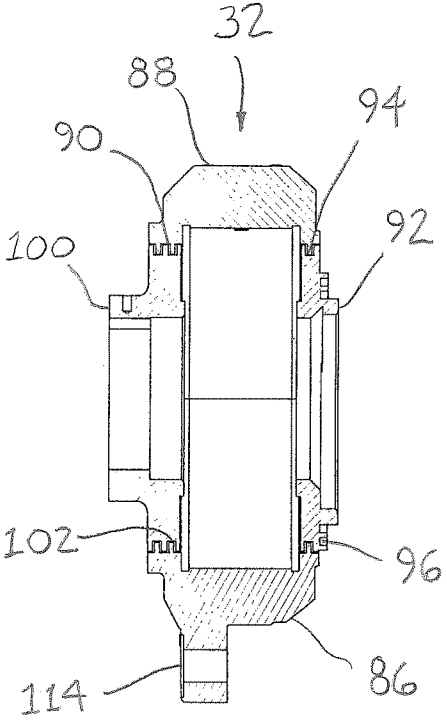
FIG. 7 is a sectional side view of the preferred float end housing assembly of the preferred housing assembly illustrated in FIGS. 1-6.

Referring now to FIG. 7, a sectional side view of preferred float end housing assembly 32 of preferred housing assembly 20 is illustrated. As shown in FIG. 7, preferred float end housing assembly 32 comprises first housing portion 86, second housing portion 88, housing assembly grooves 90, inner ring 92, inner ring housing groove 94, inner ring pitman grooves 96, outer ring 100, outer ring grooves 102, and hole 114. Preferably, the plurality of float end housing assembly grooves 90, the at least one float end inner ring housing groove 94, and the at least one float end outer ring groove 102 form a labyrinth seal.

Figure 8:
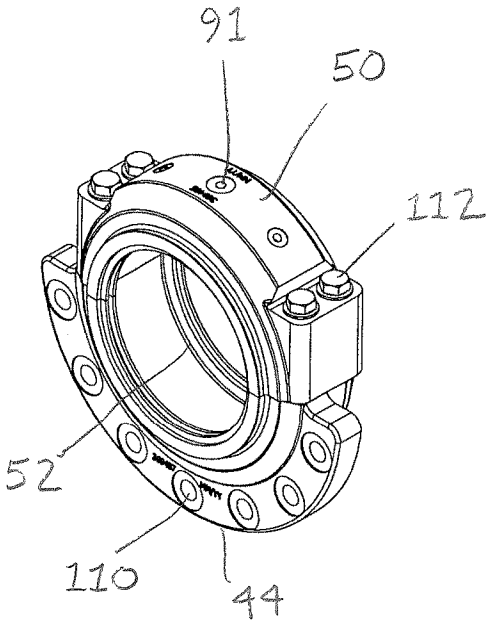
FIG. 8 is an interior side perspective view of the preferred first housing portion and second housing portion of the preferred housing assembly illustrated in FIGS. 1-7.

Referring now to FIG. 8, an interior side perspective view of preferred first housing portion 44 and second housing portion 50 of preferred housing assembly 20 is illustrated. As shown in FIG. 8, preferred first housing portion 44 comprises housing assembly grooves 52 that are machined into the first housing portion and form a labyrinth seal with the inner ring housing groove 62 and the outer ring grooves 72. Preferred first housing portion 44 also comprises a plurality of holes 110 for removably attaching the first housing portion to a rock crusher. Preferred second housing portion 50 comprises channel 91 through which fluid may be conveyed. Preferred second housing portion 50 is adapted to be removably attached to first housing portion 44 via one or more threaded fasteners such as bolts 112.

Figure 9:
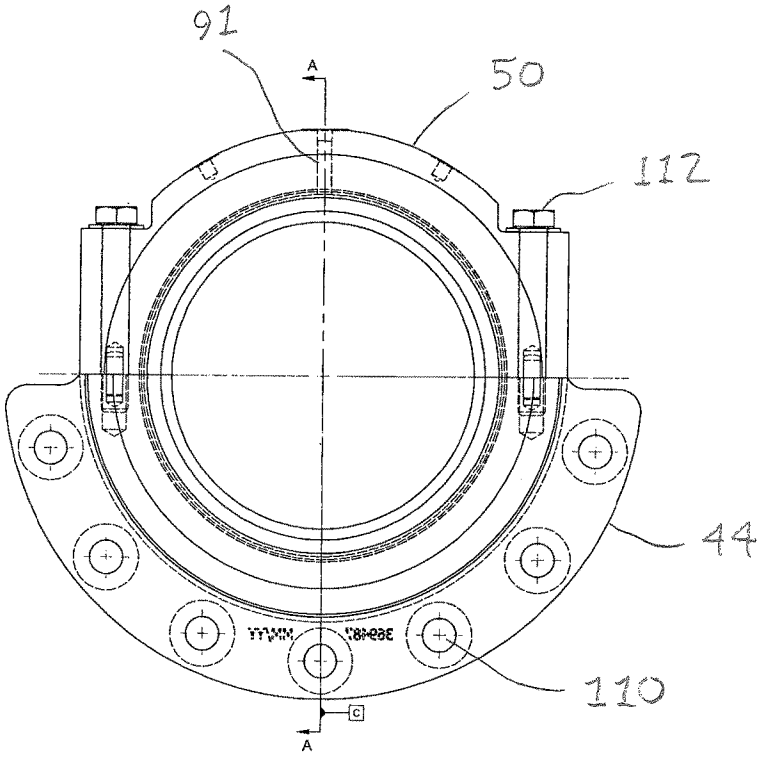
FIG. 9 is a side view of the preferred first housing portion and second housing portion of the preferred housing assembly illustrated in FIGS. 1-8.

Referring now to FIG. 9, a side view of preferred first housing portion 44 and second housing portion 50 of preferred housing assembly 20 is illustrated. As shown in FIG. 9, preferred first housing portion 44 comprises a plurality of holes 110 for removably attaching the first housing portion to a rock crusher. Preferred second housing portion 50 comprises channel 91 through which fluid may be conveyed. Preferred second housing portion 50 is adapted to be removably attached to first housing portion 44 via one or more threaded fasteners such as bolts 112.

Figure 10:
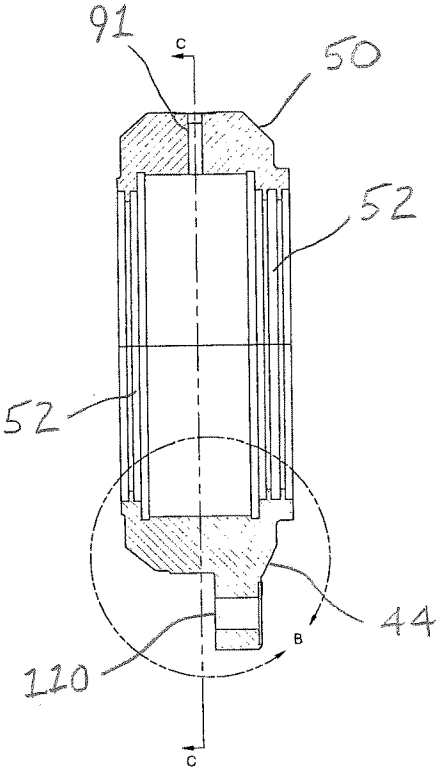
FIG. 10 is a sectional front view of the preferred first housing portion and second housing portion of the preferred housing assembly illustrated in FIGS. 1-9.

Referring now to FIG. 10, a sectional front view of preferred first housing portion 44 and second housing portion 50 of preferred housing assembly 20 is illustrated. As shown in FIG. 10, preferred first housing portion 44 comprises housing assembly grooves 52 that are machined into the first housing portion and form a labyrinth seal with the inner ring housing groove 62 and the outer ring grooves 72. Preferred first housing portion 44 also comprises a plurality of holes 110 for removably attaching the first housing portion to a rock crusher. Preferred second housing portion 50 comprises housing assembly grooves 52 that are machined into the second housing portion and form a labyrinth seal with the inner ring housing groove 62 and the outer ring grooves 72. Preferred second housing portion 50 also comprises channel 91 through which fluid may be conveyed.

Figure 11:
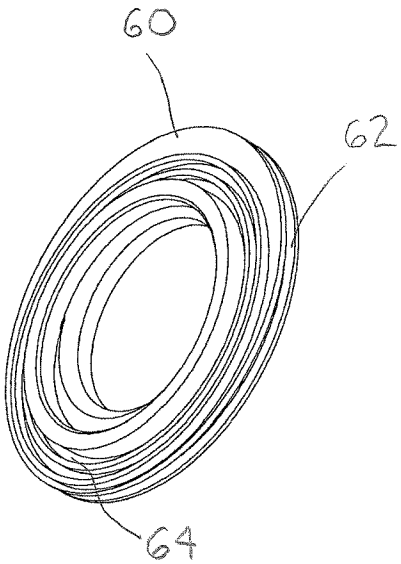
FIG. 11 is an interior side perspective view of the preferred inner ring of the preferred housing assembly illustrated in FIGS. 1-10.

Referring now to FIG. 11, an interior side perspective view of preferred inner ring 60 of preferred housing assembly 20 is illustrated. As shown in FIG. 11, preferred inner ring 60 comprises inner ring housing groove 62 and inner ring pitman grooves 64. Preferred inner ring housing groove 62 is machined into inner ring 60 and forms a labyrinth seal with housing assembly grooves 52. Preferred inner ring pitman grooves 64 are machined into inner ring 60 and form a labyrinth seal with a pitman end cover.

Figure 12:
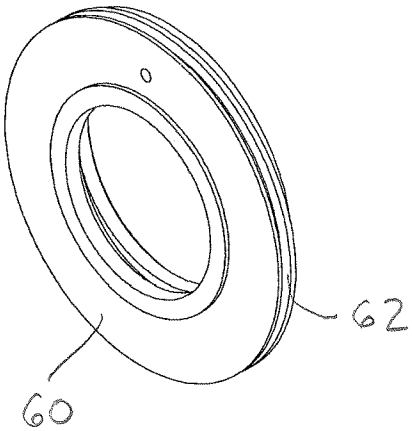
FIG. 12 is an exterior side perspective view of the preferred inner ring of the preferred housing assembly illustrated in FIGS. 1-11.

Referring now to FIG. 12, an exterior side perspective view of preferred inner ring 60 of preferred housing assembly 20 is illustrated. As shown in FIG. 12, preferred inner ring 60 comprises inner ring housing groove 62 which is machined into the inner ring and forms a labyrinth seal with housing assembly grooves 52.

Figure 13:
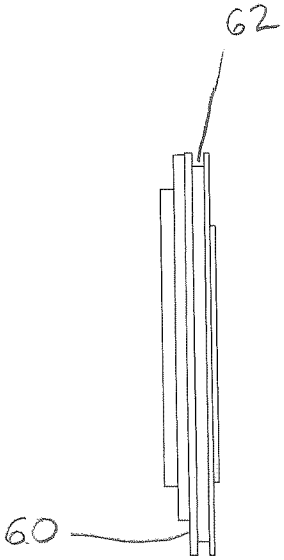
FIG. 13 is a front view of the preferred inner ring of the preferred housing assembly illustrated in FIGS. 1-12.

Referring now to FIG. 13, is a front view of preferred inner ring 60 of preferred housing assembly 20 is illustrated. As shown in FIG. 13, preferred inner ring 60 comprises inner ring housing groove 62 which is machined into the inner ring and forms a labyrinth seal with housing assembly grooves 52.

Figure 14:
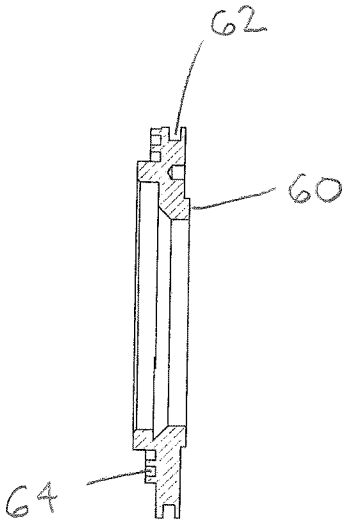
FIG. 14 is a front sectional view of the preferred inner ring of the preferred housing assembly illustrated in FIGS. 1-13.

Referring now to FIG. 14, a front sectional view of preferred inner ring 60 of preferred housing assembly 20 is illustrated. As shown in FIG. 14, preferred inner ring 60 comprises inner ring housing groove 62 and inner ring pitman grooves 64. Preferred inner ring housing groove 62 is machined into inner ring 60 and forms a labyrinth seal with housing assembly grooves 52. Preferred inner ring pitman grooves 64 are machined into inner ring 60 and form a labyrinth seal with the pitman end cover.

Figure 15:
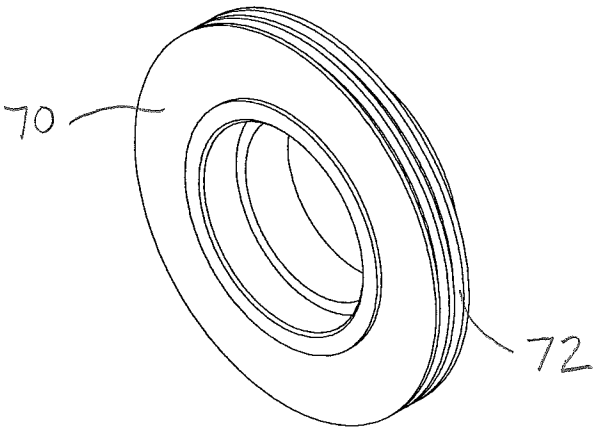
FIG. 15 is an interior side perspective view of the preferred outer ring of the preferred housing assembly illustrated in FIGS. 1-14.

Referring now to FIG. 15, an interior side perspective view of preferred outer ring 70 of preferred housing assembly 20 is illustrated. As shown in FIG. 15, preferred outer ring 70 comprises outer ring grooves 72 which are machined into the outer ring and form a labyrinth seal with housing assembly grooves 52.

Figure 16:
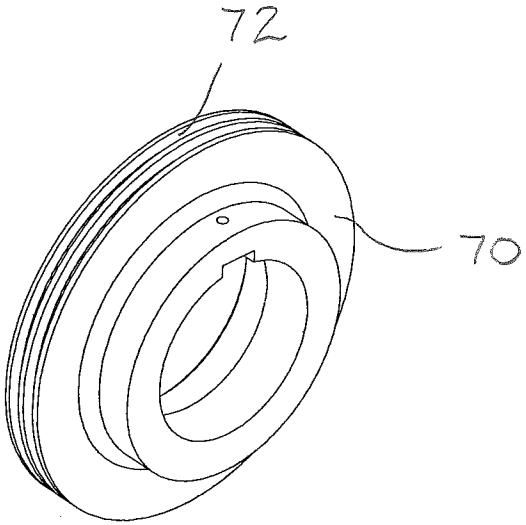
FIG. 16 is an exterior side perspective view of the preferred outer ring of the preferred housing assembly illustrated in FIGS. 1-15.

Referring now to FIG. 16, an exterior side perspective view of preferred outer ring 70 of preferred housing assembly 20 is illustrated. As shown in FIG. 16, preferred outer ring 70 comprises outer ring grooves 72 which are machined into the outer ring and form a labyrinth seal with housing assembly grooves 52.

Figure 17:
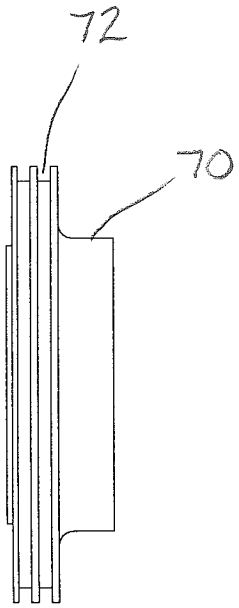
FIG. 17 is a front view of the preferred outer ring of the preferred housing assembly illustrated in FIGS. 1-16.

Referring now to FIG. 17, a front view of preferred outer ring 70 of preferred housing assembly 20 is illustrated. As shown in FIG. 17, preferred outer ring 70 comprises outer ring grooves 72 which are machined into the outer ring and form a labyrinth seal housing assembly grooves 52.

Figure 18:
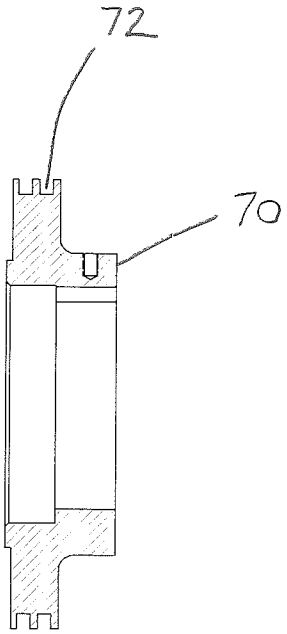
FIG. 18 is a front sectional view of the preferred outer ring of the preferred housing assembly illustrated in FIGS. 1-17.

Referring not to FIG. 18, a front sectional view of preferred outer ring 70 of preferred housing assembly 20 is illustrated. As shown in FIG. 18, preferred outer ring 70 comprises outer ring grooves 72 which are machined into the outer ring and form a labyrinth seal housing assembly grooves 52.

The invention also comprises a method for removably housing a bearing assembly on a rock crusher having an eccentric shaft. The preferred method comprises providing a housing assembly. The preferred housing assembly has an interior side and an exterior side and comprises a first housing portion having an inner side, an outer side, and a plurality of grooves and being adapted to be removably attached to the rock crusher. The preferred housing assembly also comprises a second housing portion having a plurality of grooves and being adapted to be removably attached to the first housing portion. The preferred housing assembly further comprises an inner ring having at least one inner ring housing groove and at least one inner ring pitman groove and being disposed on the interior side of the housing assembly. The preferred housing assembly still further comprises an outer ring having at least one outer ring groove and being disposed on the exterior side of the housing assembly. The preferred housing assembly is disposed around the eccentric shaft. The preferred method also comprises removing the second housing portion from the first housing portion.

In other preferred embodiments of the method for removably housing a bearing assembly on a rock crusher, the preferred housing assembly further comprises an inner spacer that is disposed on the inner side of the first housing portion and an outer spacer that is disposed on the outer side of the first housing portion. In still other preferred embodiments of the method for removably housing a bearing assembly on a rock crusher, the method further comprises removing the bearing assembly from the first housing portion, replacing the bearing assembly into the first housing portion, and attaching the second housing portion to the first housing portion.

In operation, several advantages of the preferred embodiments of the apparatus and method for a housing assembly are achieved. For example, the preferred embodiments of the apparatus and method for a housing assembly permit a bearing assembly to be easily and quickly removed from and replaced into a rock crusher. The preferred embodiments of the apparatus and method for a housing assembly also reduce the size of the housing through the use of one or more labyrinth seals. The preferred embodiments of the apparatus and method for a housing assembly also reduce the number of machined parts (e.g., a sleeve around the eccentric shaft, a bolt-on inboard seal (stationary), closure bands, a shaft nut lockwasher, and the like) and fasteners (e.g., hex cap screws, washers, lockwashers, hex nuts, and the like) and provide a robust and durable housing assembly. Further, the preferred embodiments of the apparatus and method for a housing assembly are relatively inexpensive and easy to manufacture, maintain, repair, remove, and replace. Still further, because spacers are provided in the fixed end housing assembly, the other components of the fixed end housing assembly can be identical to the components of the float end housing assembly.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A rock crusher having a base, a pitman, and an eccentric shaft with a fixed end and a float end, and a housing assembly, said housing assembly comprising:

a. a fixed end housing assembly, said fixed end housing assembly having an interior side and an exterior side and comprising:

(i) a first fixed end housing portion, said first fixed end housing portion having an inner side and an outer side and being adapted to be removably attached to the rock crusher;

(ii) a second fixed end housing portion, said second fixed end housing portion being adapted to be removably attached to the first fixed end housing portion;

wherein the fixed end housing assembly comprises a plurality of fixed end housing assembly grooves;

b. an inner spacer, said inner spacer being disposed on the inner side of the first fixed end housing portion;

c. an outer spacer, said outer spacer being disposed on the outer side of the first fixed end housing portion;

d. a fixed end inner ring, said fixed end inner ring having at least one fixed end inner ring housing groove and at least one fixed end inner ring pitman groove and being disposed on the interior side of the fixed end housing assembly;

e. a fixed end outer ring, said fixed end outer ring having at least one fixed end outer ring groove and being disposed on the exterior side of the fixed end housing assembly;

f. a float end housing assembly, said float end housing assembly having an interior side and an exterior side and comprising:

(i) a first float end housing portion, said first float end housing portion being adapted to be removably attached to the rock crusher;

(ii) a second float end housing portion, said second float end housing portion being adapted to be removably attached to the first float end housing portion;

wherein the float end housing assembly comprises a plurality of float end housing assembly grooves;

g. a float end inner ring, said float end inner ring having at least one float end inner ring housing groove and at least one float end inner ring pitman groove and being disposed on the interior side of the float end housing assembly;

h. a float end outer ring, said float end outer ring having at least one float end outer ring groove and being disposed on the exterior side of the float end housing assembly;

wherein the fixed end housing assembly is disposed around the eccentric shaft adjacent to the fixed end of the eccentric shaft; and wherein the float end housing assembly is disposed around the eccentric shaft adjacent to the float end of the eccentric shaft; and wherein the at least one fixed end outer ring groove and the at least one float end outer ring groove are disposed substantially parallel to the eccentric shaft; and wherein the fixed end housing assembly and the float end housing assembly are disposed outside the pitman and the base.

2. The housing assembly of claim 1 wherein the assembly is adapted to removably retain a bearing assembly.

3. The housing assembly of claim 1 wherein the plurality of fixed end housing assembly grooves, the at least one fixed end inner ring housing groove, and the at least one fixed end outer ring groove form a labyrinth seal.

4. The housing assembly of claim 1 wherein the plurality of float end housing assembly grooves, the at least one float end inner ring housing groove, and the at least one float end outer ring groove form a labyrinth seal.

5. The housing assembly of claim 1 wherein the first fixed end housing portion comprises a plurality of holes.

6. The housing assembly of claim 1 wherein the first float end housing portion comprises a plurality of holes.

7. The housing assembly of claim 1 wherein the fixed end housing assembly comprises a channel.

8. The housing assembly of claim 1 wherein the float end housing assembly comprises a channel.

9. The housing assembly of claim 1 wherein the plurality of fixed end housing assembly grooves are machined into the fixed end housing assembly.

10. The housing assembly of claim 1 wherein the plurality of float end housing assembly grooves are machined into the float end housing assembly.

11. The housing assembly of claim 1 wherein the at least one fixed end inner ring housing groove is machined into the fixed end inner ring.

12. The housing assembly of claim 1 wherein the at least one fixed end outer ring groove is machined into the fixed end outer ring.

13. The housing assembly of claim 1 wherein the at least one float end inner ring housing groove is machined into the float end inner ring.

14. The housing assembly of claim 1 wherein the at least one float end outer ring groove is machined into the float end outer ring.

15. The housing assembly of claim 1 wherein the fixed end inner ring and the fixed end outer ring are adapted to rotate with the eccentric shaft.

16. The housing assembly of claim 1 wherein the first fixed end first housing portion and the second fixed end second housing portion are stationary when the eccentric shaft rotates.

17. The housing assembly of claim 1 wherein the float end inner ring and the float end outer ring are adapted to rotate with the eccentric shaft.

18. The housing assembly of claim 1 wherein the first float end first housing portion and the second float end housing portion are stationary when the eccentric shaft rotates.

* * * * *